United States Patent [19]

Kostermeier

[11] 4,194,545

[45] Mar. 25, 1980

[54] CUTTER BLOCK ARRANGEMENT FOR WOOD CHIPPING MACHINES

[75] Inventor: Karl H. Köstermeier, Wollstein, Fed. Rep. of Germany

[73] Assignee: Vereinigte Edelstahlwerke Aktiengesellschaft (VEW), Vienna, Austria

[21] Appl. No.: 920,498

[22] Filed: Jun. 29, 1978

[30] Foreign Application Priority Data

Jul. 7, 1977 [DE] Fed. Rep. of Germany ..... 2730800

[51] Int. Cl.[2] ..... B26D 1/12; B27G 13/04

[52] U.S. Cl. ..... 144/230; 144/174

[58] Field of Search ..... 144/172, 174, 176, 218, 144/230; 83/698

[56] References Cited

U.S. PATENT DOCUMENTS

| | | | |
|---|---|---|---|
| 3,014,511 | 12/1961 | Kirsten | 144/230 |
| 3,854,511 | 12/1974 | Maier | 144/230 |
| 3,989,077 | 11/1976 | Humbert | 144/230 |

FOREIGN PATENT DOCUMENTS

| | | |
|---|---|---|
| 240032 | 9/1964 | Austria . |
| 2220003 | 12/1973 | Fed. Rep. of Germany . |

*Primary Examiner*—John Sipos
*Assistant Examiner*—W. D. Bray
*Attorney, Agent, or Firm*—Brumbaugh, Graves, Donohue & Raymond

[57] ABSTRACT

A cutter block arrangement for wood chipping machines has blades mounted in blade holders that are fastened to holding ledges by means of a tongue and groove connection. The holding ledges are mounted in a groove of the cutter block body by means of fastening screws. The blades have cutting edges and are positively inserted in the blade holders, while the holding ledges are supported relative to the cutter block body by means of adjusting screws counteracting the fastening screws so as to adjust a certain projection of the cutting edges of the blades.

9 Claims, 2 Drawing Figures

CUTTER BLOCK ARRANGEMENT FOR WOOD CHIPPING MACHINES

BACKGROUND OF THE INVENTION

The invention relates to a cutter block for wood chipping machines, comprising blades mounted in blade holders, which blade holders being fastened to holding ledges by means of a tongue and groove connection while the holding ledges are mounted in a groove of a cutter block body by means of fastening screws.

A cutter block of this kind is known from Austrian Pat. No. 240,032. The holding ledge can be adjusted by means of the fastening screws for the purpose of adjusting the projection of the blade cutting edge. Because of the play inherent in this construction between the fastening screws and the holding ledges, and between the fastening screws and the cutter block body, respectively, an exact adjustment of the blade cutting edges to the desired path is possible only if these parts are produced with the utmost accuracy. A further disadvantage of this cutter block is that the blades are mounted on the blade holder only by means of an easily shifted friction-engagement connection, which may cause further inaccuracies of the projection of the blade cutting edge.

In German Offenlegungsschrift No. 2,220,003 a cutter block construction is disclosed in which shim ledges, to which the blades are positively mounted, are themselves mounted to the blade holders by means of a friction-engagement connection and the blade holders are each positively fastened to a holding ledge. With this construction the holding ledges are not adjustable relative to the cutter block body. Adjustment of the projection of the blade cutting edge is effected by adjustment screws provided on the blade carriers and supporting the shim ledges. Adjustment of the blade cutting edge projection exactly to a predetermined extent is possible with this construction, but requires a lot of work.

It is further known to fasten disposable blades in a blade holder composed of a blade carrier and a wear ledge, by means of a tongue and groove connection (German Offenlegungsschrift No. 2,514,548). The blade holders, which are also positively inserted in the cutter block in this case, are fixed in their position, so that adjustment of different blade cutting edge projections is possible only by special blade adjusting means. In order that, in the known cutter block, all disposable blades can be positioned exactly on the same path, an extremely accurate production of the cutter block and the blade holders is required, i.e. within small tolerances.

Attempts have also been made to make blade cutting edge projections adjustable by providing each blade carrier with several feather key grooves differing in their radial position relative to the cutter block, into which feather key grooves the feather keys holding the disposable blades are inserted according to the desired blade cutting edge projection. The production of such blade carriers is time consuming due to the plurality of the feather key grooves to be provided and the small tolerances with which they must be produced, and so is an adjustment of the blades.

SUMMARY OF THE INVENTION

The invention aims at avoiding these disadvantages and difficulties and has as its objects to provide a cutter block which is produceable with tolerances that need not be very small, the blades nevertheless being alignable exactly to the desired path.

Accordingly to the invention these objects are achieved in a cutter block of the initially-described kind in that the blades, as known per se, are inserted with positive engagement into the blade holders and the holding ledges are supported against the cutter block by adjusting screws acting against the fastening screws for the purpose of adjustment of the blade cutting edge projection. With this construction, the exact adjustment of the blade cutting edge projection to a predetermined extent is possible with simple means. The cutter block according to the invention also makes it possible to exchange the blade holders in the cutter block, while still observing the exact projection of the blade cutting edge, so that no particular sequence of the blade holders within the cutter block needs to be followed.

Preferably, spring elements are provided between the holding ledges and the fastening screws. By this provision, the blade cutting edge projection can be adjusted without play by mere activation of the adjusting screws.

Advantageously, the holding ledges are designed in two parts so as to be divided longitudinally by a plane inclined relative to the adjusting direction of the holding ledge. One part of the ledge is penetrated by the fastening screws and is supported, via the inclined face formed by the dividing plane, by the second part, which second part is penetrated by the adjusting screws.

Advantageously, the plane is inclined at an acute angle, preferably an angle that is smaller than the pertaining angle of friction, relative to the adjusting direction of the holding ledge. The part comprising the adjusting screws is wider at the side directed towards the block centre than at the side lying opposite that side. This two-part design of the holding ledge causes the holding ledge to self-lockingly clamp to the cutter block, if centrifugal forces occur through the cutter block. By this means the holding ledge will be free from play during operation of the cutter block, but is nevertheless easily and adjustably mounted within the cutter block during a standstill of the cutter block.

According to a preferred embodiment the adjusting screws are operable from outside the block by an adjustment means including a wrench that is introduceable into the blade holder recess after removal of the blade holder and attachment of adjusting device to the holding ledge.

BRIEF DESCRIPTION OF THE DRAWINGS

The invention will be explained in more detail by way of one embodiment and with reference to the accompanying drawings, wherein.

DESCRIPTION OF A PREFERRED EMBODIMENT

Figure 1:
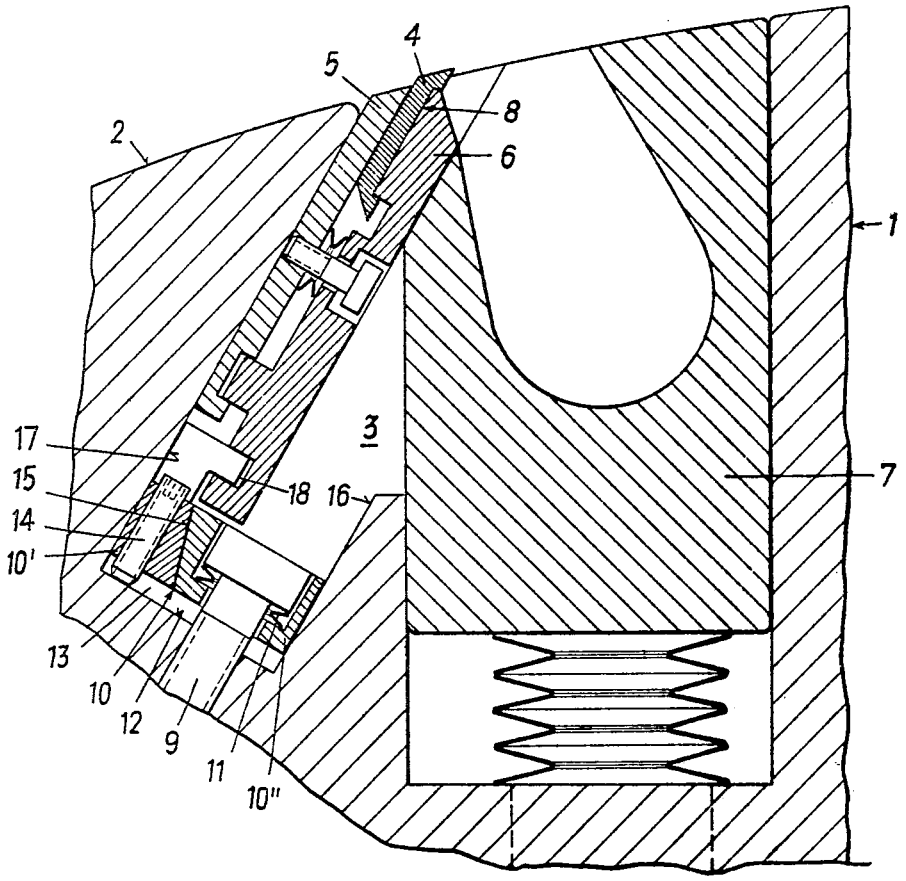
FIG. 1 shows a partial representation of a section transverse to the axis of a cutter block with installed blades.

A cutter block body 1 comprises recesses 3 directed obliquely to its cylindrical surface 2 and parallel to the axis of. The cutter block, the recesses are evenly distributed over the surface 2 of the cutter block in the peripheral direction and each serves for accommodating one blade 4. The blades are each inserted in a blade holder that is composed of a wear plate 5 and a blade carrier 6. Centrifugal wedges 7, which are spring-mounted, on the one hand press the blade carrier against the wear plate and, on the other hand, press the blade holder formed of those parts to the cutter block body. For fixing the position of the blade 4 relative to the blade carrier 6, a tongue and groove connection 8 is provided between the disposable-reversible blade 4 made of strip steel and the blade carrier 6. The blade holder is connected with a holding ledge 10 by means of a tongue and groove connection 18, the holding ledge being fastened to the cutter block by means of screws 9 consecutively arranged in the longitudinal direction of the block. Between the screw bodies of the fastening screws 9 and the holding ledge, cup springs 11 are arranged for pressing the holding ledge against the base 12 of a groove 13 that accommodates the holding ledge. With the help of adjusting screws 14 (which act against the fastening screws 9, penetrate the holding ledge and are supported at the base 12 of the groove 13) the position of the holding ledge 10 relative to the cutter block can be precisely adjusted.

The holding ledge 10 advantageously is designed in two parts by being longitudinally divided by a plane 15 obliquely inclined relative to the adjusting direction of the holding ledge 10. One part 10' is penetrated by adjusting screws 14 and the other part 10'' by the fastening screws 9. By the effect of the oblique dividing plane 15, the two parts 10', 10'' are pressed against the side walls 16, 17 of the groove 13, whereby the holding ledge 10 lies without play in the groove. The plane 15 is suitably inclined relative to the adjusting direction of the holding ledge at an angle that is smaller than the pertaining angle of friction. The part 10' comprising the adjusting screws 14 is wider on the side directed towards the block centre than on the side lying oppositely that side, so that the centrifugal forces acting on the blade holder cause a clamping of the holding ledge 10 in the groove 13, which clamping is maintained also during standstill of the block because of the frictional self-locking along the plane 15.

Figure 2:
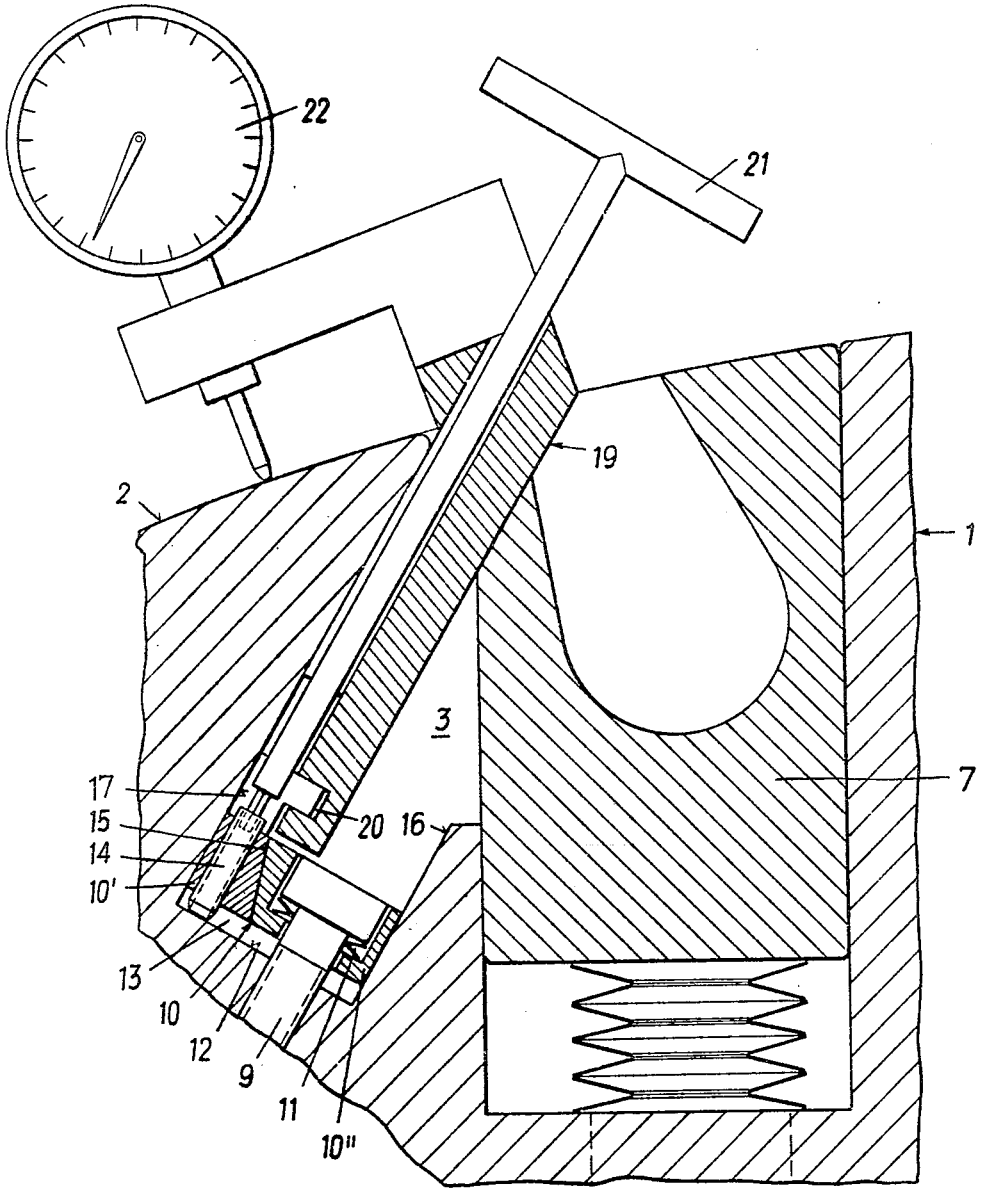
FIG. 2 illustrates the adjustment of the blade projection by the adjustment means.

For adjusting a certain projection of the blade cutting edge, the blade holder is removed from the cutter block and is replaced by an adjustment device illustrated in FIG. 2 and denoted by 19. The adjustment device also is fixed relative to the holding ledge by a tongue and groove connection 20. At first the screw 9 is slightly loosened so that the action of the spring elements 11 has only slight effects. Via an adjusting wrench 21, which engages with a hexagon socket (not illustrated) of the adjusting screw, the holding ledge 10 can be adjusted relative to the cutter block. The extent adjusted can be read off of a gauge 22 that is in contact with the cylindrical surface 2 of the cutter block and rigidly connected with the adjusting device 19. Afterwards the fastening screw is again tightened.

The adjusting procedure is only a short one, so that the adjustment of the blade cutting edge projections of a cutter block having a plurality of blades can also be effected within a short period of time. Touching of the cutting edges of the blades is prevented, so that the blades will not suffer any damage caused by the adjusting procedure. Since after the adjusting procedure all holding ledges 10 have been brought to the same distance from the block surface 2, independently of the exactness of the cutter block body 1, which body can be reduced by deformations caused by wear and heat tensions, no special allocation of the blade holders 5, 6 to the recesses 3 has to be observed when installing the blade holders. They are all equal, i.e. any blade holders in store can be inserted into any of the recesses of the cutter block body. This is, for instance, advantageous if the blade holders are removed from the cutter block body for cleaning and are replaced by blade holders that have already been cleaned. Adjustment to the new blade holders is not necessary any longer.

The invention is of importance also for cutter blocks with regrindable blades, since the time consumption for newly adjusting the holding ledges, e.g. after every block service, is considerably reduced.

What I claim is:

1. A cutter block arrangement for wood chipping machines comprising:

a cutter block body having grooves with bases at their bottoms, holding ledges, each ledge being provided in a respective one of said grooves, fastening screws for fastening said holding ledges to said cutter block body in a fastening direction toward the base of the groove, blade holders, each holder being fastened to a respective holding ledge by a tongue and groove connection, blades having cutting edges and being positively held in said blade holders, and adjusting screws for supporting said holding ledges at an adjustable distance relative to the bases of the respective grooves in said cutter block body, and in a direction opposite to the fastening direction of said fastening screws, for adjustment of a certain projection of said cutting edges.

2. A cutter block arrangement for wood chipping machines comprising:

a cutter block body having grooves with bases at their bottoms, holding ledges, each ledge being provided in a respective one of said grooves, fastening screws for fastening said holding ledges to said cutter block body in a fastening direction toward the base of the groove, spring elements provided between said holding ledges and said fastening screws, blade holders, each holder being fastened to a respective holding ledge by a tongue and groove connection, blades having cutting edges and being positively held in said blade holders, and adjusting screws for supporting said holding ledges at an adjustable distance relative to the bases of the respective grooves in said cutter block body, and in a direction opposite to the fastening direction of said fastening screws, for adjustment of a certain projection of said cutting edges.

3. A cutter block arrangement for wood chipping machines comprising:

a cutter block body having grooves with bases at their bottoms, holding ledges, each ledge being provided in a respective one of said grooves, each of said holding ledges being longitudinally divided into two parts by a dividing plane, fastening screws for fastening said holding ledges to said cutter block body in a fastening direction toward the base of the groove, blade holders, each holder being fastened to a respective holding ledge by a tongue and groove connection, blades having cutting edges and being positively held in said blade holders, and adjusting screws for supporting said holding ledges at an adjustable distance relative to the bases of the respective grooves in said cutter block body, and in a direction opposite to the fastening direction of said fastening screws, for adjustment of a certain projection of said cutting edges, the dividing plane of each holding ledge being inclined relative to the adjusting direction of said holding ledge and forming an oblique face, the first of said parts of said holding ledge being penetrated by said fastening screw, the second part being penetrated by said adjusting screw, and said first part being supported via said oblique face on the second part.

4. A cutter block arrangement as set forth in claim 3, wherein said dividing plane is inclined to the adjusting direction of said holding ledges at an acute angle, and wherein each second part has a first side directed towards the centre of said cutter block body and a second side lying opposite said first side, said first side being wider than said second side.

5. A cutter block arrangement as set forth in claim 4, wherein said acute angle is smaller than the pertaining angle of friction.

6. An adjustment means for adjusting the projection of a blade in a cutter block arrangement that includes a cutter block body having grooves, separate holding ledges provided for each of said grooves, fastening screws for fastening said holding ledges in the grooves of said cutter block body, separate blade holders fastened to each of said respective holding ledges by tongue and groove connections, said blades having cutting edges and being positively held in said blade holders, and adjusting screws for supporting said holding ledges relative to said cutter block body at an adjustable distance and in a direction opposite to the fastening direction of said fastening screws, said adjustment means comprising:

an adjusting device which is attachable to said holding ledges in said grooves after removal of said blade holders from said grooves, and a wrench introduceable into said groove via said adjusting device for actuating said adjusting screws from outside the cutter block body.

7. An adjustment means as claimed in claim 6 wherein said adjusting device is attachable to said holding ledges by a tongue and groove connection.

8. An adjustment means as claimed in claim 7 wherein the tongue and groove connection of said adjusting device includes part of the tongue and groove connection of said blade holders.

9. An adjustment means as claimed in claim 6 wherein part of said adjusting device extends out of said groove and above the cutter block body in a direction tangential to the peripheral surface of said cutter block body, and wherein said adjustment means further includes a distance measuring means for measuring the distance of the part of the adjusting device above the peripheral surface of the cutter block body to indicate the adjusted position of said holding ledges.

* * * * *